US005673166A

United States Patent [19]

Hoffman

[11] Patent Number: 5,673,166

[45] Date of Patent: Sep. 30, 1997

[54] DITHER MAGNITUDE CONTROL

[75] Inventor: J. Paul Hoffman, Peoria, Ill.

[73] Assignee: Caterpillar Inc., Peoria, Ill.

[21] Appl. No.: 717,145

[22] Filed: Sep. 20, 1996

Related U.S. Application Data

[63] Continuation of Ser. No. 442,908, May 17, 1995, abandoned.

[51] Int. Cl.[6] ..... H01H 47/32

[52] U.S. Cl. ..... 361/160

[58] Field of Search ..... 361/152–156, 361/160

[56] References Cited

U.S. PATENT DOCUMENTS

| | | | |
|---|---|---|---|
| 4,432,033 | 2/1984 | Brundage | 361/152 |
| 4,485,424 | 11/1984 | Niwa et al. | 361/152 |
| 4,536,818 | 8/1985 | Nielsen | 361/154 |
| 4,546,403 | 10/1985 | Nielsen | 361/154 |
| 4,661,766 | 4/1987 | Hoffman et al. | 323/287 |
| 4,898,361 | 2/1990 | Bender et al. | 251/129 |
| 4,967,309 | 10/1990 | Hoffman | 361/160 |
| 4,978,865 | 12/1990 | Hartmann et al. | 307/140 |
| 5,079,498 | 1/1992 | Cleasby et al. | 323/283 |
| 5,083,982 | 1/1992 | Sato | 474/28 |
| 5,214,561 | 5/1993 | Morita | 361/187 |
| 5,222,417 | 6/1993 | Sato | 74/861 |
| 5,432,693 | 7/1995 | Anderson | 363/41 |

*Primary Examiner*—Fritz Fleming
*Attorney, Agent, or Firm*—David M. Masterson

[57] ABSTRACT

Apparatus and method for controlling dither in a solenoid actuator. Circuitry produces a frequency command signal in response to a measured dither parameter and produces a current command signal. A solenoid actuator input signal is delivered to a solenoid actuator, said solenoid actuator input signal having a frequency determined in response to the frequency command signal and a magnitude of current determined in response to a current command signal.

10 Claims, 2 Drawing Sheets

DITHER MAGNITUDE CONTROL

This is a file wrapper continuation of application Ser. No. 08/442,908, filed May 17, 1995, now abandoned.

TECHNICAL FIELD

This invention relates generally to a control for a solenoid driver circuit, and more particularly, to a method and apparatus for controlling the dither signal of a solenoid driver circuit.

BACKGROUND ART

Solenoid actuators convert electrical energy into mechanical motion. Such devices can be used in a wide range of devices and applications including household appliances and earthmoving equipment.

Solenoid actuators often have problems with stiction and hystersis which lessen the effectiveness and responsiveness the system. In general, when current is applied to a linear-type solenoid, an armature moves into the solenoid, or an armature moves outward from the solenoid dependent upon the particular solenoid design. Stiction, or friction, is higher when the armature is at rest compared to when it is moving. Accordingly, when the armature is at rest, there is a certain delay from the time the solenoid command signal is received until there is actual mechanical motion because the magnetic forces must exceed the stiction before there is mechanical motion. Stiction produces an undesirable result known as hystersis.

To overcome or minimize the effects of these types of problems, it is known to apply a dither signal to the actual command signal of certain solenoid actuators. In this way, the solenoid actuator is constantly in small-amplitude motion. An example of such a solenoid driving circuit is described in U.S. Pat. No. 4,546,403 to Nielsen. Nielson, as with other known solenoid circuitry, only teaches the application of a single frequency dither signal which cannot be varied. With a single frequency, the actual amount of the dither magnitude will vary in accordance with the command signal. Nielson does not teach how to control the dither magnitude to maintain it at a constant optimal level.

The dither magnitude created by the duty-cycle excitation of a proportional work solenoid is not constant. It varies with the magnitude of the commanded current. In some circumstances, this change in the dither magnitude is not acceptable due to high performance requirements. In other circumstances, it is desirable to vary the amount of dither magnitude in response to parameters that affect the optimal amount of dither, such as hydraulic oil temperature or the amount of use a particular solenoid has received.

In addition, to save on warehousing space and production costs, it is desirable to use a generic driver circuit that is capable of operating in connection with a variety of different solenoid types. However, there may be a different amount of dither that is optimal for each type of solenoid to be used with the generic driver. It would therefore be advantageous to provide a common driving circuit for which the dither could be controlled to correspond to the optimal amount for each particular solenoid and according to machine operating conditions that impact upon solenoid operation.

The present invention avoids the disadvantages of known driving circuits by providing an apparatus and method for controlling the frequency, and thus dither magnitude, of the signal driving a solenoid actuator.

The present invention is directed to overcoming one or more of the foregoing problems associated with known solenoid driver circuitry.

DISCLOSURE OF THE INVENTION

In one aspect of the invention, an apparatus for controlling dither in a solenoid actuator is provided. The apparatus includes a microprocessor for producing a current command signal, frequency producing means for producing a frequency command signal in response to a dither parameter, and solenoid driver means for producing a solenoid actuator input signal whose frequency is a function of the frequency command signal and whose magnitude is a function of the magnitude of current command signal.

In a second aspect of the invention, a method for controlling dither in a solenoid actuator is provided. The method includes the steps of producing a current command signal, producing a frequency command signal in response to a dither parameter, measuring a dither parameter, generating a solenoid actuator input signal whose frequency is a function of the frequency command signal and whose magnitude is a function of the magnitude of current command signal, and delivering the solenoid actuator input signal to the solenoid actuator.

The invention also includes other features and advantages which will become apparent from a more detailed study of the drawings and specification.

DETAILED DESCRIPTION OF THE PREFERRED EMBODIMENT OF THE INVENTION

Figure 1:
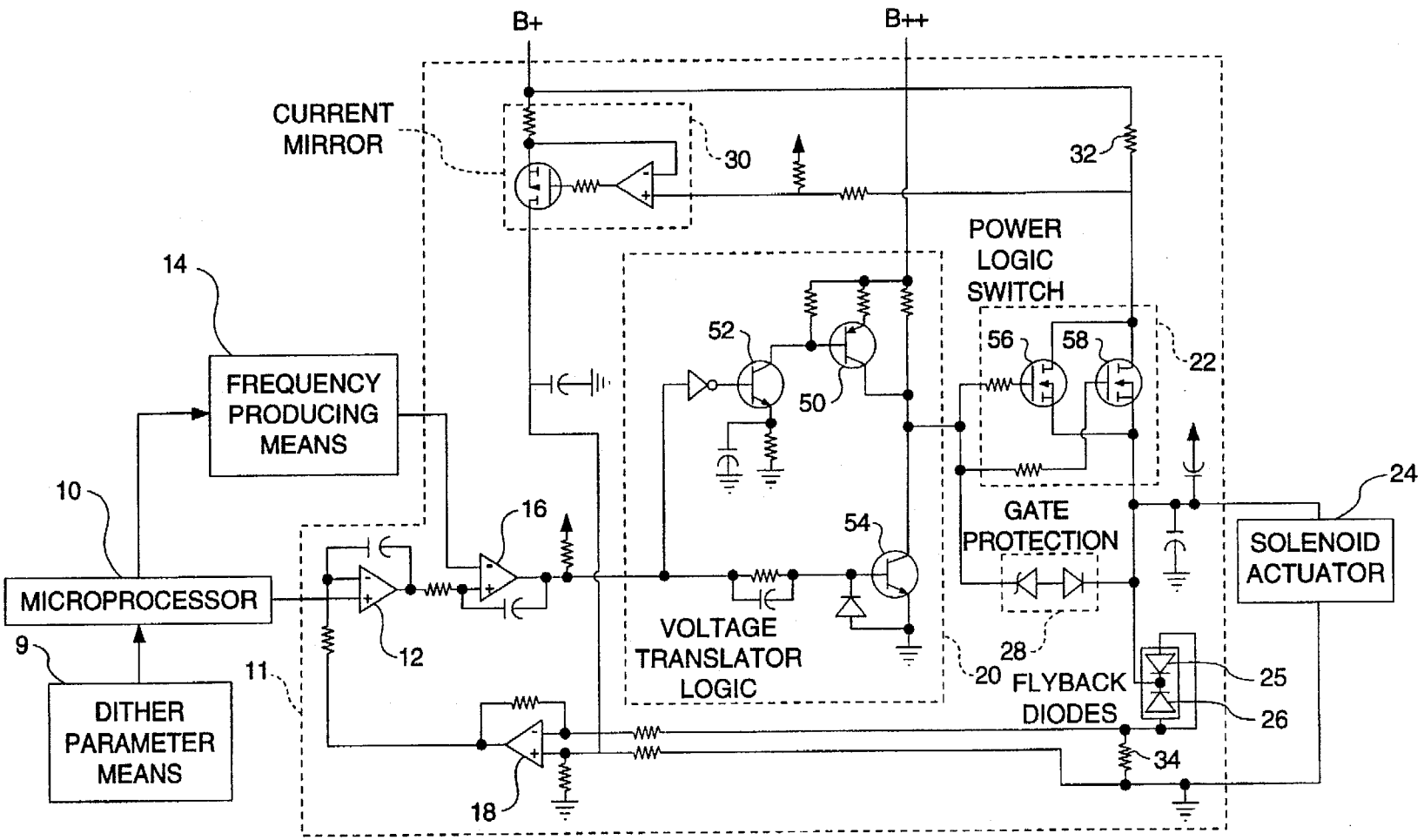
FIG. 1 is a schematic diagram of a preferred embodiment of a solenoid river circuit.
Figure 2:
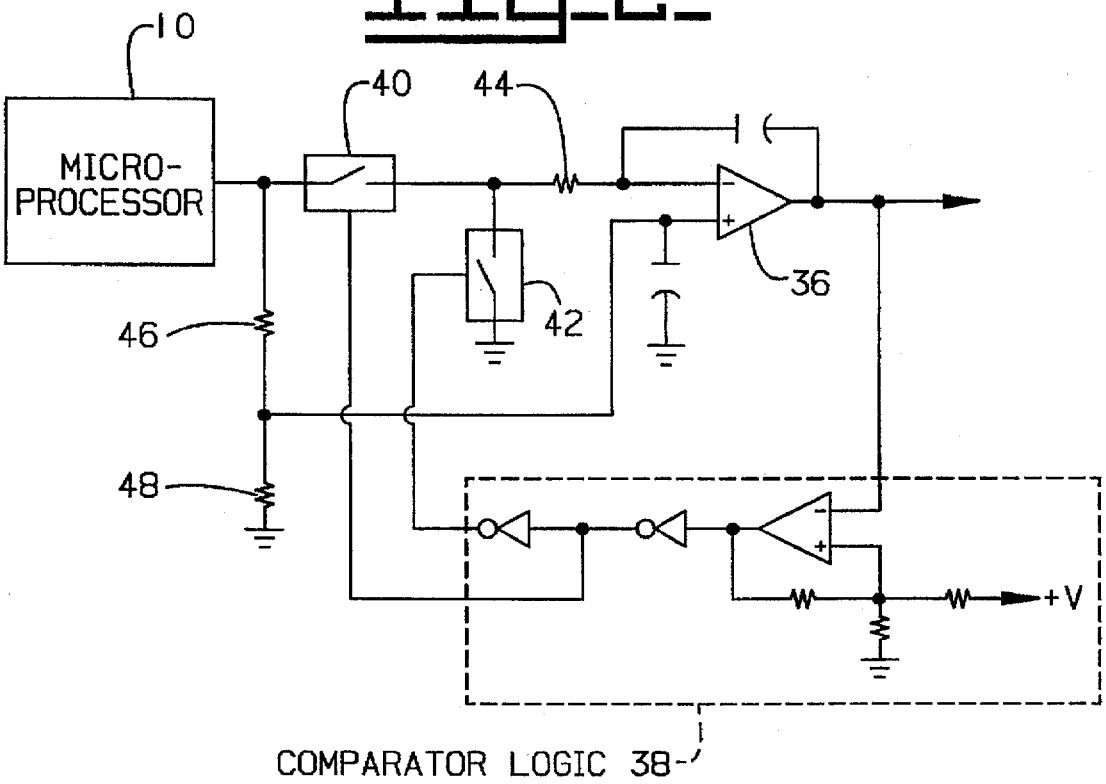
FIG. 2 is a schematic diagram of one embodiment of a voltage controlled oscillator.
Figure 3:
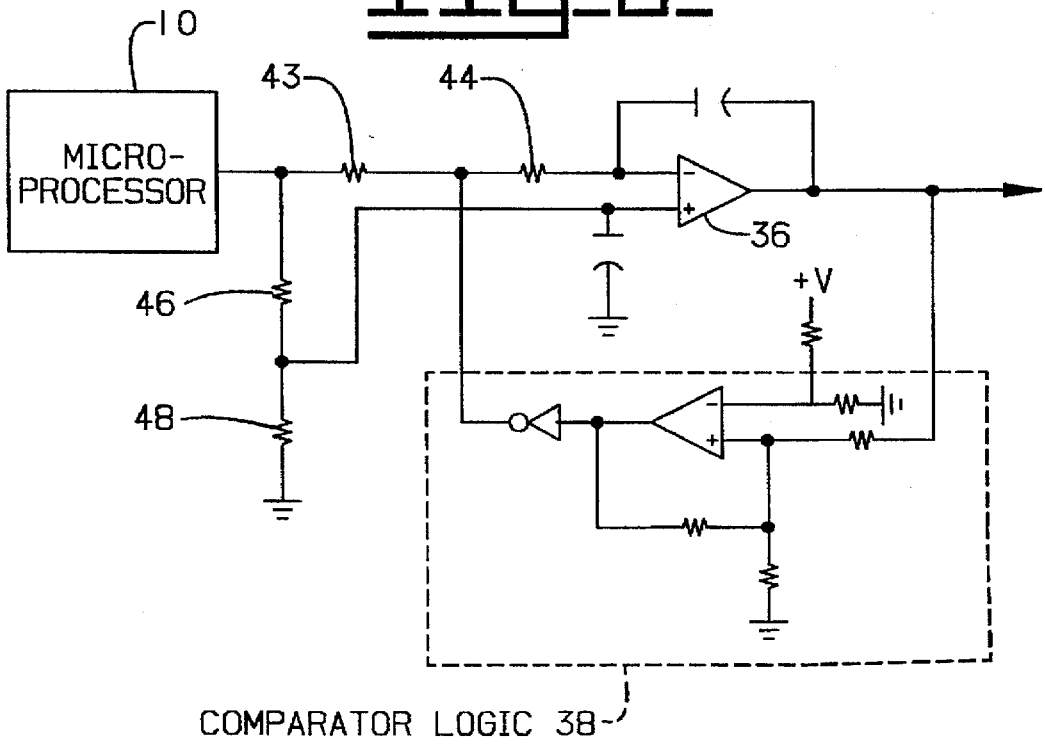
FIG. 3 is a schematic diagram of another embodiment of a voltage controlled oscillator.

Referring first to FIGS. 1–3, a schematic diagram of a preferred embodiment of the solenoid driver circuit is shown. A current command signal of a preselected magnitude is controllably produced by a microprocessor 10. A dither parameter is measured and a dither parameter signal is delivered to the microprocessor 10 by a dither parameter means 9. The dither parameter signal is indicitive of the dither parameter. In response to the dither parameter signal, the microprocessor 10 delivers a dither command signal to a frequency producing means 14. Responsively, the frequency producing means 14 produces a frequency command signal.

The current command and the frequency command signals are received and a solenoid actuator input signal is generated in response to said received signals. The actuator input signal's frequency is a function of the frequency of the received frequency command signal and the actuator input signal's magnitude is a function of the magnitude of the received current command signal. The solenoid actuator input signal is delivered to the solenoid actuator and the actuator is controlled in response to this received solenoid actuator input signal.

Examples of the dither parameters that may be used for controlling the solenoid actuator are, for example, hydraulic oil temperature, solenoid actuator usage, an identification code which corresponds to a preselected type of solenoid actuator and other parameters as will be apparent to one skilled in the art.

Referring to FIG. 1, a preferred embodiment of the present invention includes a microprocessor 10 which produces a current command signal and a frequency producing means 14 is provided for producing the frequency command signal in response to the dither parameter. These signals are delivered to the solenoid driver means 11 which is connected to the microprocessor 10, the frequency producing means 14, and the solenoid actuator 24. In response, the solenoid driver means 11 determines a solenoid actuator input signal that is delivered to the solenoid actuator 24 and controls the solenoid actuator as is further described below.

The microprocessor 10 produces a current command signal. The current command signal is supplied to the positive input of a first differential amplifier 12. The output of the first differential amplifier 12 is the integrated difference between the current command signal and a signal representing the current through the solenoid from a second differential amplifier 18.

The output of the first differential amplifier 12 is supplied to the positive input of a comparator 16. The output of the frequency producing means 14, a triangular waveform, is supplied to the negative input of the comparator 16. Two different embodiments of the frequency producing means 14 are illustrated in FIGS. 2 & 3 and will be discussed in greater detail later in the detailed description.

The output of the comparator 16 is the solenoid actuator input signal and is a square wave. The solenoid actuator input signal is a function of the frequency of the frequency producing means 14 and the magnitude of the current command signal produced by the microprocessor 10. The solenoid actuator input signal is supplied to a voltage translation logic 20.

The voltage translation logic 20 translates, i.e., boosts the solenoid actuator input signal to the proper voltage level to engage a power switch logic 22. The output of the power switch logic 22 is connected to the solenoid actuator 24 and supplies the solenoid actuator input signal to the solenoid actuator 24.

The solenoid driver means 11 further includes flyback diodes 25, 26 that are connected in parallel with the solenoid actuator 24. The flyback diodes 25, 26 provide a discharge current path to prevent the occurrence of large voltage spikes. In addition, a gate protection 28 is connected across the power switch logic 22. The gate protection 28 protects the power switch logic 22 from exceeding its specified maximum voltage.

A current mirror circuit 30 is connected to a first current sensing resistor 32. The current mirror 30 delivers an output signal to the positive input of the second differential amplifier 18 which is responsive to the magnitude of the current flowing through the current sensing resistor 32 when the power switch logic 22 is "on". A second current sensing resistor 34 is connected to the flyback diodes 25, 26. The junction of the second current sensing resistor 34 and the flyback diodes 25, 26 is connected to the second differential amplifier 18. The second current sensing resistor 34 delivers a signal to the negative input of the second differential amplifier 18 which is responsive to the magnitude of the current flowing through the second current sensing resistor 34 when power switch logic is "off".

Referring to the specific embodiment of the frequency producing means 14 shown in FIG. 2, the microprocessor 10 calculates and delivers a dither command signal. The dither command signal can be responsive to a number of different dither parameters. For example, there may be a range of different current command signals for a particular solenoid actuator. Each different current command signal may have a corresponding dither parameter associated with the frequency necessary to achieve the optimal dither magnitude for that particular current command signal.

Likewise, the driver circuit may be used to operate different types of solenoid actuators. There may be a different amount of dither that is optimal for each type of solenoid. Accordingly, the dither parameter may correspond to an identification code for a particular type of solenoid actuator.

The dither parameter may also be responsive to any of a number of operating conditions that would impact the desired amount of dither. For example, as a solenoid actuator operates, a certain degree of wear occurs. The appropriate amount of dither may vary as the wear on the solenoid actuator increases. Accordingly, the dither parameter could be responsive to the length of usage of the solenoid actuator. Other examples of operating conditions that may impact the desired amount of dither include: hydraulic oil temperature, weather conditions, and the amount of dirt in the solenoid actuator.

FIG. 2 shows an embodiment of the frequency producing means 14. As described above, the microprocessor 10 produces a dither command signal that corresponds to a particular dither parameter. The dither signal is integrated by a differential integrator 36 into the resultant frequency command signal. The resultant frequency command signal is in the form of a triangle wave.

The negative input of the differential integrator 36 is connected in series with a first switch 40 and a first resistor 44. A second resistor 46 and a third resistor 48 are connected in series between the junction of the output of the microprocessor 10 and the first switch 40 and ground. The resistors 44, 46, and 48 are selected such that the resistance value of the first resistor 44 is equal to the parallel equivalent resistance value of the second resistor 46 and the third resistor 48. The positive input of the differential integrator 36 is connected to the junction of the second resistor 46 and the third resistor 48 so that the resistor network forms a voltage divider.

The output of the differential integrator 36 is the frequency command signal and is delivered to a comparator logic 38. The comparator logic 38 is connected to a second switch 42. The other end of the second switch 42 is connected between the first switch 40 and the first resistor 44.

When the first switch 40 is closed, the second switch 42 is open, and when the second switch 42 is closed, the first switch 40 is open. When the first switch 40 is closed, the full input voltage of the dither command signal from the microprocessor 10 is applied to the negative input of the differential integrator 36, and because of the voltage divider function performed by resistors 46, 48, only ½ of the input voltage of the dither command signal is applied to the positive input of the differential integrator 36. Accordingly, the output of the differential integrator 36 integrates the signal "downward", i.e., the voltage level decreases over time.

The signal is integrated "downward" until it reaches a certain predetermined level. At that point, the comparator logic 38 changes the switch configuration so that the second switch 42 is closed and the first switch 40 is open. When the first switch 40 is open, the voltage applied to the negative input of the differential integrator 36 is zero. However, ½ of the input voltage is still applied to the positive input of the differential integrator 36. Accordingly, the differential integrator integrates the signal "upward", i.e., the voltage level increases over time.

The signal is integrated "upward" until it reaches a predetermined level. At that point, the comparator logic 38 changes the switch configuration so that the first switch 40 is closed and the second switch 42 is open. The resultant frequency command signal is in the form of a triangle wave. The magnitude of the slope of the triangle wave in both the upward and downward directions is equal owing to the fact that each path has the same R-C network value.

FIG. 3 shows another embodiment of the frequency producing means 14. This embodiment operates in a similar manner described for FIG. 2. The embodiment of FIG. 3 does not utilize switches, rather there is a switch to ground. Accordingly, the circuit can be constructed in a less expensive manner. However, the embodiment of FIG. 3 will not produce a frequency command signal in which the magnitude of the slopes in the upward and downward direction are equal.

Referring to the embodiment shown in FIG. 3, the microprocessor 10 produces a dither command signal that corresponds to a particular dither parameter. The dither command signal is integrated by a differential integrator 36 into the resultant frequency command signal. The resultant frequency command signal is in the form of a triangle wave.

The negative input of the differential integrator 36 is connected in series with a first resistor 44 and a fourth resistor 43. A second resistor 46 and a third resistor 48 are connected in series between the junction of the output of the microprocessor 10 and fourth resistor 43 and ground. The positive input of the differential integrator 36 is connected to the junction of the second resistor 46 and the third resistor 48 so that the resistor network forms a voltage divider.

The output of the differential integrator 36 is the frequency command signal and is delivered to a comparator logic 38. The output stage of the comparator logic 38 is an open-drain device and is connected to the junction between the first and fourth resistors 43, 44. In operation, the dither command signal from the microprocessor 10 is applied to the negative input of the differential integrator 36, and ½ of the voltage of the dither command signal is applied to the positive input of the differential integrator 36. With the larger voltage at the negative input, differential integrator 36 integrates "downward" to a predetermined level. At that point, the comparator logic 38 will change states and the junction between the first and fourth resistors 43 and 44 will be shorted to ground. The voltage applied to the negative input of the differential integrator 36 is now zero. However, ½ of the input voltage is still applied to the positive input of the differential integrator 36. Accordingly, the differential integrator integrates the signal "upward" until it reaches a certain predetermined level.

Referring again to FIG. 1, certain aspects of the operation of the solenoid driver means will be described in greater detail.

The voltage translation logic 20 includes a first transistor 50, a second transistor 52, and a third transistor 54. The voltage translation logic 20 boosts the solenoid actuator input signal to the proper voltage level to engage the power switch logic 22. In particular, when the comparator 16 produces a logic "1", the third transistor 54 is "on" and the first and second transistors 50 and 52 are "off." When the comparator 16 produces a logic "0", the third transistor 54 is "off" and first and second transistors 52 and 50 are "on", causing the output of the first transistor 50 to pull up to B++.

The power switch logic 22 includes a first and second N-channel enhancement mode MOSFET switch 56, 58. The power switch logic 22 respectively connects and disconnects the solenoid actuator 24 in response to the output of the voltage translation logic 20. When the first transistor 50 is pulled up to the B++ voltage level, the gates of the first and second MOSFET switches 56, 58 are pulled to a high potential and power is delivered to the solenoid actuator 24.

In operation, the solenoid driver means 11 will operate to maintain a current level in the solenoid actuator 24 within prescribed limits of the desired current in addition to adjusting for the desired dither frequency. The solenoid driver means 11 will interact with the first differential amplifier 12 which is supplied with a signal that is responsive to the magnitude of the current in solenoid actuator 24 to maintain the current level in the solenoid actuator within the prescribed limits.

Industrial Applicability

The solenoid driver circuitry of the present invention is used to accurately control solenoid actuator 24 which in turn positions a spool of an electronically controlled proportional hydraulic valve at a preselected position. The dither parameter provides the information necessary to determine the frequency to achieve the optimum dither magnitude. The frequency producing means 14 generates the frequency command signal which is responsive to the dither parameter and corresponds to the optimum dither magnitude.

The current command signal provides a reference to the first differential amplifier 12 indicative of a desired position of the valve spool. The solenoid driver means 11 operates to provide the solenoid actuator 24 with an input signal with a frequency that is a function of the frequency of the frequency command signal and a magnitude that is a function of the magnitude of the received current command signal.

Other aspects, objects, and advantages of this invention can be obtained from a study of the drawings, the disclosure, and the appended claims.

We claim:

1. An apparatus for controlling dither in a solenoid actuator, comprising:

a microprocessor adapted to produce a current command signal;

dither parameter means for measuring a dither parameter and producing a dither parameter signal that is indicative of a desired dither frequency, wherein the microprocessor receives the dither parameter signal and responsively produces a dither command signal;

frequency producing means for receiving the dither command signal and producing a frequency command signal that is responsive to the dither parameter; and solenoid driver means for receiving the current command and frequency command signals and producing a solenoid actuator input signal to drive the solenoid actuator to a desired position, wherein the frequency of the solenoid actuator input signal is a function of the frequency command signal and the magnitude is a function of the current command signal.

2. An apparatus, as set forth in claim 1, wherein said dither parameter is responsive to hydraulic oil temperature.

3. An apparatus, as set forth in claim 1, wherein said dither parameter is responsive to the length of solenoid actuator usage.

4. An apparatus, as set forth in claim 1, wherein said dither parameter is an identification code.

5. An apparatus, as set forth in claim 4, wherein said identification code corresponds to a preselected type of solenoid actuator.

6. A method for controlling dither in a solenoid actuator, comprising the steps of:

producing a current command signal of a preselected magnitude;

measuring a dither parameter and producing a dither parameter signal that is indicative of a desired dither frequency;

producing a dither command signal in response to the dither parameter signal;

producing a frequency command signal in response to the dither command signal;

generating a solenoid actuator input signal whose frequency is a function of the frequency command signal and whose magnitude is a function of the magnitude of current command signal; and delivering the solenoid actuator input signal to the solenoid actuator.

7. A method, as set forth in claim 6, wherein said dither parameter is responsive to hydraulic oil temperature.

8. A method, as set forth in claim 6, wherein said dither parameter is responsive to the length of solenoid actuator usage.

9. A method, as set forth in claim 6, wherein said dither parameter is an identification code.

10. A method, as set forth in claim 9, wherein said identification code corresponds to a preselected type of solenoid actuator.

* * * * *